United States Patent [19]

Johnson, Jr. et al.

[11] 3,942,463

[45] Mar. 9, 1976

[54] MOVABLE RAMP INLET FOR WATER JET PROPELLED SHIPS

[75] Inventors: Virgil E. Johnson, Jr., Gaithersburg; Robert J. Etter, Ellicott City; Horton W. Lain, Severna Park; Larry K. Stephens, Glenelg; Peter Van Dyke, Baltimore, all of Md.

[73] Assignee: The United States of America as represented by the Secretary of the Navy, Washington, D.C.

[22] Filed: Oct. 1, 1974

[21] Appl. No.: 510,950

[52] U.S. Cl. ..... 115/11

[51] Int. Cl.[2] ..... B63H 11/04

[58] Field of Search ..... 115/11, 16, 12 R, 14, 15; 137/15.1, 15.2; 60/221, 222; 244/53 B

[56] References Cited

UNITED STATES PATENTS

| | | | |
|---|---|---|---|
| 2,024,274 | 12/1935 | Campini | 115/11 |
| 2,971,331 | 2/1961 | Silverman et al. | 137/15.1 |
| 3,265,331 | 8/1966 | Miles | 244/53 B |
| 3,456,664 | 7/1969 | Foote | 137/15.2 |
| 3,757,728 | 9/1973 | Rhoda | 115/16 |

FOREIGN PATENTS OR APPLICATIONS

| | | | |
|---|---|---|---|
| 1,931,495 | 1/1971 | Germany | 115/11 |

*Primary Examiner*—Duane A. Reger
*Assistant Examiner*—Gregory W. O'Connor
*Attorney, Agent, or Firm*—R. S. Sciascia; Q. E. Hodges; D. McGiehan

[57] ABSTRACT

A movable ramp, forming part of the inlet flow channel of a water jet propulsion system, is adjustable to provide variable inlet area for various speed and propulsion requirements. In this flush or semi-flush type inlet, the lower lip is stationary and an upper ramp, forming an extension of the base-line shell, directs the flow into the inlet. If the baseline shell is not suited to the inlet installation, (for example, if a high deadrise angle exists) a forebody fairing is provided to make the baseline shell geometry suitable. The ramp is flexible, has a smooth surface, and is backed up by bell cranks and pusher bars that can move the ramp position to change the inlet area. The ramp position or inlet area may be adjusted manually or automatically to meet the requirements of speed and propulsion. If the centerline of the lip leading edge radius falls below the normal baseline (semi-flush inlet) suitably shaped "sideplates" are provided to avoid inlet cavitation or ventilation at yawed conditions. A "pressure alleviation" system may be provided to reduce the static pressure differential across the ramp to alleviate the structural design loading and reduce the total force required of an actuator to move the ramp.

8 Claims, 2 Drawing Figures

MOVABLE RAMP INLET FOR WATER JET PROPELLED SHIPS

The invention described herein may be manufactured and used by or for the Government of the United States of America for governmental purposes without the payment of any royalties thereon or therefor.

BACKGROUND OF THE INVENTION

The instant invention relates generally to water jet propulsion apparatus for ships and more particularly to an inlet system having a variable inlet area adjusted by a movable ramp.

In a high speed water jet propulsion system the inlet to the pump is perhaps the most critical component besides the pump because it operates at ship speed and often in a non-uniform velocity field and is thus highly susceptible to cavitation or ventilation. In addition, waterjet efficiency is influenced by inlet system drag and internal losses or energy recovery. Also, pump cavitation is highly dependent on the energy recovery and the outlet velocity distribution of the inlet. Cavitation and internal ventilation of the inlet due to excessive yaw angles can result in degradation of pump and water jet performance, and the cavitation may cause erosion damage.

There are basically two types of inlet systems for water jet propulsion systems, the flush or semi-flush inlet, and the pod-strut or ram inlet. Pod-strut type inlets usually have the inlet opening away from the ship hull on a strut and are required for hydrofoil craft. The flush and semi-flush type inlets have the inlet adjacent to or buried in the hull and are currently favored for surface effect ships.

For most high speed ships, such as the surface effect ships and hydrofoils, significant differences in inflow angles and inlet velocity ratio [(IVR)=average inlet velocity divided by ship velocity] occur at different speeds when fixed geometry inlets are used. Furthermore, to permit cavitation-free operation over these widely varying inflow angles, large inlet leading edge or lip radii or thicknesses are required, which results in a severe drag penalty. If the area of the inlet could be varied such that the inlet velocity ratio (IVR) remained constant over the speed range, the "angle-of-attack" on the lip would remain constant and therefore the leading edge radius of the lip could be small. To vary the area of these flush inlets there are two practical schemes—either move the lip or move the ramp.

SUMMARY OF THE INVENTION

Accordingly, an object of the instant invention is to provide a movable ramp inlet for water jet propelled ships.

Another object of the present invention is to provide a new and improved variable area inlet for water jet propulsion systems.

Still another object of the instant invention is to provide a variable area inlet for water jet propulsion systems that is efficient through a range of ship speeds.

A further object of the present invention is to provide a flush type water jet inlet having reduced drag at all speeds and angles of attack (inlet velocity ratios).

A further object of the present invention is to provide a variable area inlet for water jet propulsion which is made structurally feasible using a pressure alleviation system.

A still further object of the present invention is to provide a flush type water jet inlet capable of tolerating a reasonable range of yaw angles without ventilating or cavitating.

A still further object of the present invention is to provide an inlet for water jet propulsion systems minimizing inlet losses, cavitation and internal ventilation while maximizing energy recovery and water jet efficiency.

Briefly these and other objects of the instant invention are attained by the use of a movable ramp faired with the ship's baseline shell and extending into the inlet flow channel for varying the inlet area of the water jet propulsion system. In this flush or semi-flush type inlet the lip which splits the flow of water past the hull and the water taken into the inlet remains stationary. The smooth flexible ramp surface is backed up and moved by a mechanism of bell cranks and pusher bars to change the inlet area and moves between side plates. The structural design of the movable ramp is in some cases made feasible through the use of a pressure alleviation system which allows higher static pressure fluid from the diffuser to vent to the region behind the ramp and thus alleviate a portion of the structural load due to the primary flow entering the inlet. The pressure alleviation system also reduces the total force required of an actuator to move the ramp. An angle-of-attack sensor on the lip may automatically sense and send signals to adjust the ramp to the requirements, or the ramp may be adjusted manually to obtain optimum results.

BRIEF DESCRIPTION OF THE DRAWINGS

A more complete understanding of the invention and many of the attendant advantages thereof will be readily appreciated as the same become better understood by reference to the following detailed description when considered in connection with the accompanying drawing wherein.

DESCRIPTION OF THE PREFERRED EMBODIMENT

Figure 1:
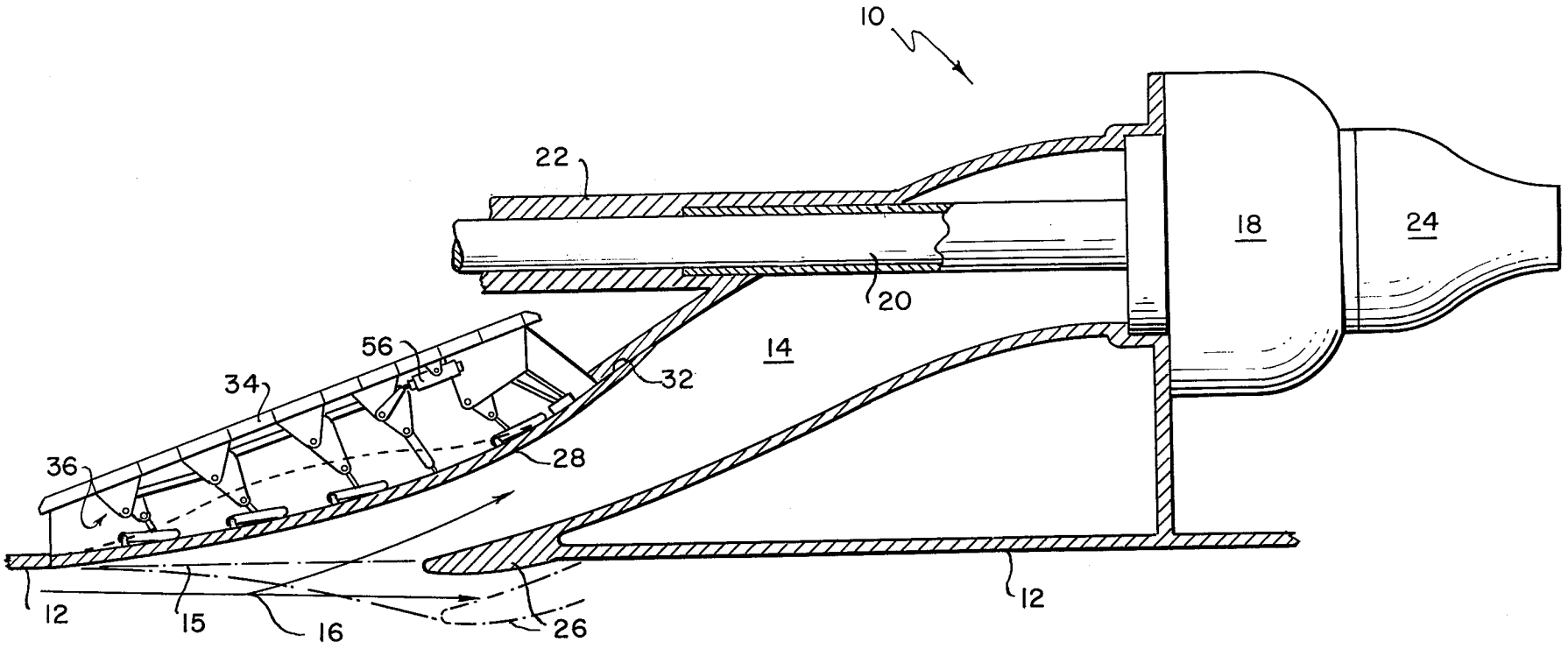
FIG. 1 is a sectional view, in elevation showing a water jet propulsion system.

Referring now to the drawings, wherein like reference numerals designate corresponding parts throughout the several views, there is shown generally in FIG. 1 a water jet propulsion system 10 attached to the baseline shell 12 of a ship or the like. The water jet propulsion system has a pump means inlet channel 14 that is the flush or semi-flush type taking a portion of the water stream as shown by the flow arrows 16. The inlet channel 14 directs the water to a pump 18 having a shaft 20 for rotation in journals 22. The pump 18 forces the water in a high velocity water jet out a nozzle 24.

Referring particularly to the inlet channel 14, there is a lip 26 attached near the baseline shell 12 toward the aft of the inlet which acts to split the flow of the water passing the hull. At the forward end of the inlet 14 at the baseline shell a movable ramp 28 is faired into the baseline shell 12 to form a continuous smooth surface. The ramp is constructed of a sufficiently flexible thin material, such as steel, aluminum, or the like to assume the required and predetermined shapes chosen for hydrodynamic reasons and change of inlet area. The difficulties in providing significant area variations should not be underestimated since the required variation in area may be a factor as high as four to five. FIG. 1 shows the generally desired shape of the movable ramp at the two extremes. The solid shape corresponds to a small opening required for high speed operation, and the dotted line shape corresponds to a large opening required for low speed operation. The ramp 28 moves in a sealing relationship between two side plates 15, the edges of which are flush with the baseline shell 12 and shown by the two dot-dash lines, each line representing the side plate profiles for alternative positions of lip 26.

Figure 2:
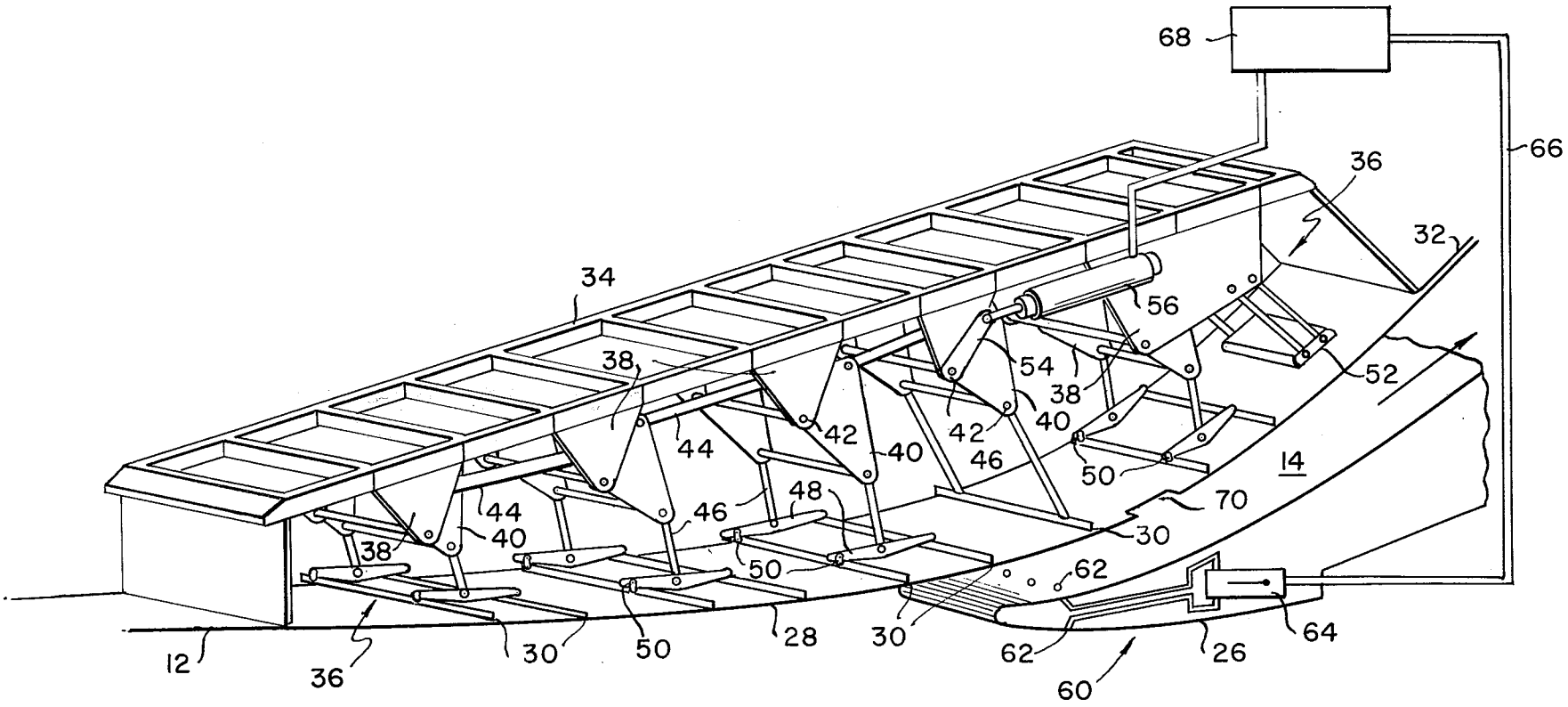
FIG. 2 is a perspective view in elevation of the adjustable ramp inlet according to the invention.

Referring now to FIG. 2 the movable ramp 28 is a single flexible plate faired into the baseline shell 12 at the forward end. It is laterally supported by transverse stiffeners 30 and by a slip joint 32 at the after end, and by the side plates 15 shown in FIG. 1. The required ramp shape is assumed through the use of a linkage system assembled to a bedplate 34 firmly secured to the hull structure. Attached to the bedplate 34 are a plurality of dual side-by-side sets of linkages 36 located on the bedplate to reduce stresses on the stiffeners 30 and to provide transverse stability to the ramp 28. In the typical linkage system shown, each set of linkages 36 comprises five double-plate shaft bearing supports 38 fixedly attached to the bedplate 34 which rotatably support five bell cranks 40 on shafts 42 extending between the sets of linkages 36. Each bell crank 40 is substantially triangular in shape and is connected at its corners to one or two push-pull rods 44 which interconnect neighboring bell cranks and to another push-pull rod 46 which rotatably attaches to the center of a spreader bar 48 or directly to a stiffener 30 mounted on the ramp 28. One end of the spreader 48 is rotatably connected directly to a stiffener 30, and the other end is rotatably connected with a take up link 50 to the next adjacent stiffener to allow for distance changes as the ramp flexes. A double link swing block 52 is provided near the aft end of the ramp to allow overall change of ramp length.

To provide movement of the ramp system, one of the bell crank shafts 42 is fixed against rotation to the bell crank. Therefore, a crank arm 54 is also fixed to that shaft 42 against rotation so that a push rod of an actuator 56 provides the force which causes all the bell cranks 40 to rotate so as to position the ramp. The actuator may be a linear hydraulic ram or a mechanical screw type ram.

In summary, the linkage system is designed so that the ramp 28 is held in the proper shape at any position from full down to full up, and this maybe attained in design by choosing various shaft 42 positions, bell crank 40 turning angles, and link and push-pull rod 46 lengths. In this preferred embodiment there are eight points of support. First, the attachment of the ramp at the forward end is faired into the baseline shell 12. At the next three points of ramp support, spreaders 30 are attached to and divide the ramp into panels. The fifth point is located over the lip 26 and is attached directly to the ramp to obtain accurate placement in this critical area. Further aft there is another support with a spreader and then the swing block support 52 which limits ramp plate angular motion. The last support is the slip joint 32 faired into the after end of the inlet flow channel 14. A feature of the inlet system which may sometimes be required to make the structural design of the ramp 28 more feasible while providing the required flexibility is a "pressure alleviation" system in which higher static pressure fluid from the diffuser flow channel 14 is vented across the ramp. The venting passage may be a port, duct, or valve in the ramp, or a notch 70 in the edge of the ramp. The pressure alleviation system will also reduce the total force required of the actuator 56.

The actuator 56 which provides the force to adjust the position of the ramp may be controlled manually, or automatically by an angle-of-attack sensor 60 in the leading edge of the lip 26. In this preferred embodiment the sensor comprises pressure ports 62 on both the upper and lower surface of the lip to detect the static pressure differential caused by various angles of attack. This static pressure differential actuates a differential pressure switch 64 which produces an electrical signal. The electrical signal is fed via conductors 66 to a servo valve 68 which is hydraulically connected to the actuator 56. In operation it is to be remembered that the inlet lip is like the leading edge of an airfoil whose operating angle-of-attack is very much a function of the inlet velocity ratio, IVR. Therefore the ramp is moved whenever the lip angle-of-attack strays from the desired angle corresponding to a cavitation-free IVR. Therefore, the signal generated by the static differential pressure sensors is conditioned and used to operate the differential pressure switch 64 which acts as a limit switch or deadband type of control. That is, when the signal exceeds allowable limits, the electrical signal to the servo valve 68 causes the control actuator 56 to move the ramp 28 to a position such that the differential pressure control signal returns to within the allowable limits.

Obviously many modifications and variations of the present invention are possible in light of the above teachings. It is therefore to be understood that within the scope of the appended claims, the invention may be practiced otherwise than as specifically described.

What is claimed is:

1. An adjustable inlet flow channel for a water jet propulsion system of a ship mounted in the baseline shell of a ship and to avoid cavitation comprising:

a stationary lip in the aft portion of the inlet substantially flush with the baseline shell for diverting water into the inlet; and a movable, flexible ramp forming the top of the inlet faired to the baseline shell at the forward end of the inlet and to a pump means inlet channel for adjusting the area of the inlet.

2. The adjustable inlet flow channel of claim 1, wherein said movable ramp further comprises:

a flexible continuous plate faired into the baseline shell; and a linkage system attached between the hull and said flexible plate at a plurality of movable support points.

3. The adjustable inlet flow channel of claim 2 wherein said movable ramp further comprises:

a bedplate secured to the hull structure supporting said linkage system;

a plurality of transverse stiffeners secured to said flexible plate;

a plurality of push-pull rods rotatably connected to said stiffeners; and a plurality of bell cranks rotatably connected between said push-pull rods and said bedplate;

whereby actuation of said bell cranks causes said linkage system to move said ramp into a desired position.

4. The adjustable inlet flow channel of claim 3 further comprising:

a hydraulic push-pull actuator connected between said bedplate and said bell cranks for actuating the linkage system.

5. The adjustable inlet flow channel of claim 4 further comprising:

an angle-of-attack sensor on said lip coupled to said actuator.

6. The adjustable inlet flow channel of claim 5 wherein said angle-of-attack sensor comprises:

a plurality of pressure ports on both the upper and lower surface of said lip;

a differential pressure switch hydraulically coupled to said pressure ports; and a servo valve interposed between said differential pressure switch and said actuator.

7. The adjustable inlet flow channel of claim 4 further comprising:

a port in said ramp whereby the ramp structural design is made feasible and the force required of said actuator is reduced.

8. The adjustable inlet flow channel of claim 7 further comprising in the baseline of the ship:

fairing means for making the baseline shell geometry suitable for installation of said inlet system; and sidewall plate means, adapted to avoid cavitation or ventilation at yawed conditions.

* * * * *